US007522860B2

(12) United States Patent
Shiraki

(10) Patent No.: US 7,522,860 B2
(45) Date of Patent: Apr. 21, 2009

(54) DEVELOPER CARTRIDGE FOR IMAGE-FORMING DEVICE

(75) Inventor: Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 230 days.

(21) Appl. No.: 11/520,664

(22) Filed: Sep. 14, 2006

(65) Prior Publication Data

US 2007/0059038 A1 Mar. 15, 2007

(30) Foreign Application Priority Data

Sep. 14, 2005 (JP) ..... 2005-267042

(51) Int. Cl.
*G03G 15/04* (2006.01)

(52) U.S. Cl. ..... 399/119; 399/262

(58) Field of Classification Search ..... 399/107, 399/111, 113, 119, 120, 262
See application file for complete search history.

(56) References Cited

U.S. PATENT DOCUMENTS

| | | | | |
|---|---|---|---|---|
| 5,103,764 | A * | 4/1992 | Fujiwara et al. | 399/226 |
| 5,923,926 | A * | 7/1999 | Isobe et al. | 399/119 |
| 6,507,386 | B2 * | 1/2003 | Inomata | 355/27 |
| 6,708,013 | B2 * | 3/2004 | Nomura | 399/167 |
| 6,823,160 | B2 | 11/2004 | Okabe | |
| 7,082,274 | B2 * | 7/2006 | Saitoh et al. | 399/110 |
| 7,242,890 | B2 * | 7/2007 | Yokota | 399/111 |
| 7,460,816 | B2 * | 12/2008 | Okabe | 399/222 |
| 2003/0185594 | A1 | 10/2003 | Okabe | |
| 2004/0086300 | A1 | 5/2004 | Kawai et al. | |
| 2005/0063735 | A1 | 3/2005 | Okabe | |
| 2007/0122188 | A1 * | 5/2007 | Igarashi | 399/119 |

FOREIGN PATENT DOCUMENTS

| | | |
|---|---|---|
| EP | 1041456 A2 | 10/2000 |
| JP | 7-334036 | 12/1995 |
| JP | 9-171339 | 6/1997 |
| JP | 2000-221864 | 8/2000 |
| JP | 2003-295614 | 10/2003 |
| JP | 2004-117988 | 4/2004 |

OTHER PUBLICATIONS

Extended European Search Report dated Jun. 1, 2007 in Application No. EP06019102.0.

* cited by examiner

*Primary Examiner*—Hoan H Tran
(74) *Attorney, Agent, or Firm*—Banner & Witcoff, Ltd.

(57) ABSTRACT

A developer cartridge is detachably mountable in an image-forming device having a driving rotator. The developer cartridge includes a developing roller and a driven rotator. The driven rotator is movable in an advancing direction parallel to an axial direction of the developing roller toward the driving rotator and in a retracting direction opposite the advancing direction. The driven rotator receives a driving force from the driving rotator when coupled with the driving rotator, thereby rotating the developing roller.

20 Claims, 9 Drawing Sheets

DEVELOPER CARTRIDGE FOR IMAGE-FORMING DEVICE

CROSS REFERENCE TO RELATED APPLICATIONS

This application claims priority from Japanese Patent Application No. 2005-267042 filed Sep. 14, 2005. The entire content of each of these priority applications is incorporated herein by reference.

TECHNICAL FIELD

The disclosure relates to an image-forming device, such as a laser printer, and a developer cartridge detachably mountable in the image-forming device.

BACKGROUND

Developer cartridges that are detachably mounted in an image-forming device are well known in the art. One such developer cartridge disclosed in U.S. Pat. No. 6,823,160 includes a developing roller, and an input gear for receiving a driving force from the main body of the image-forming device and transmitting the driving force to the developing roller. A coupling member is also provided in the main body of the image-forming device for engaging with and rotating the input gear in the developer cartridge. This coupling member is made to engage with and retract from the input gear in association with the opening and closing of a cover on the main body of the image-forming device when mounting and removing the developer cartridge.

SUMMARY

However, movable parts are generally prone to failure. When movable parts, such as the coupling member, are provided in the main body of the image-forming device, failure of the movable parts would require repair of the main body of the image-forming device. This repair process would entail a complex operation of disassembling and reassembling the image-forming device.

In view of the foregoing, it is an object of the invention to provide an image-forming device and a developer cartridge detachably mounted in the image-forming device that can facilitate maintenance operations.

In order to attain the above and other objects, it is an object of the invention to provide a developer cartridge that is detachably mountable in an image-forming device having a driving rotator. The developer cartridge includes a developing roller and a driven rotator. The driven rotator is capable of coupling the driven rotator when the developer cartridge is mounted in the image-forming device. The driving rotator is movable in an advancing direction parallel to an axial direction of the developing roller toward the driving rotator and in a retracting direction opposite the advancing direction. The driven rotator receives a driving force from the driving rotator when coupled with the driving rotator, thereby rotating the developing roller.

The invention also provides an image-forming device. The image-forming device includes a main casing, a driving rotator, and a developer cartridge. The main casing includes a side wall. The driving rotator is disposed on the main casing. The developer cartridge is detachably mountable in the main casing. The developer cartridge includes a developing roller and a driven rotator that is movable in an advancing direction parallel to an axial direction of the developing roller toward the driving rotator and in a retracting direction opposite the advancing direction. The driven rotator receives a driving force from the driving rotator when coupled with the driving rotator, thereby rotating the developing roller. The side wall opposes the driven rotator when mounting and detaching the developer cartridge to and from the main casing. The side wall includes a first wall part, a second wall part, and a third wall part. The first wall part runs parallel to a mounting direction of the developer cartridge that is orthogonal to the advancing and retracting directions. The driving rotator is disposed on the first wall part. The second wall part runs parallel to the mounting direction and is disposed upstream of the first wall part in the mounting direction and downstream in the advancing direction. The third wall part is disposed between the first and second wall parts in the mounting direction and sloped toward the upstream side in the advancing direction from the upstream side to the downstream side in the mounting direction.

BRIEF DESCRIPTION OF THE DRAWINGS

Illustrative aspects in accordance with the invention will be described in detail with reference to the following figures wherein:

FIG. 5(*b*) is an explanatory diagram of a gear mechanism disposed at the left side of the developer cartridge showing the rotational direction of gears;

FIG. 6(*b*) is a schematic diagram showing a state in which the developer cartridge opposes the first wall part and the driving gear is disengaged from the input gear by a collar;

FIG. 6(*c*) is a schematic diagram showing a state in which the developer cartridge opposes a second wall part;

FIG. 8(*b*) is a perspective diagram showing the front cover in a closed state;

FIG. 9(*b*) is a schematic view showing the driving gear and the input gear in a non-coupled state according to the variation of aspects; and FIG. 9(*c*) is a schematic view showing the input gear positioned in front of the driving gear according to the variation of the aspects.

DETAILED DESCRIPTION

Figure 1:
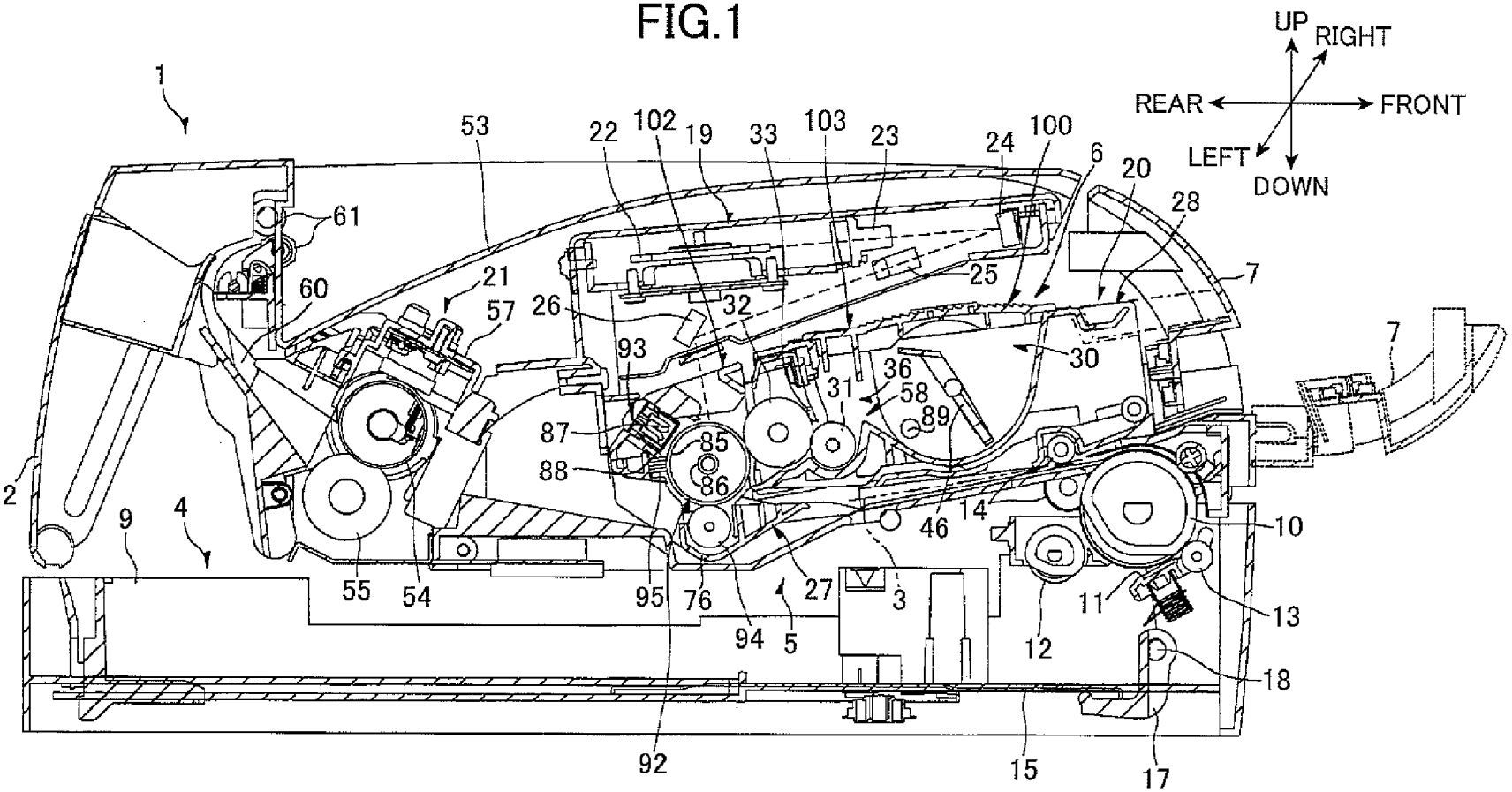
FIG. 1 is a side cross-sectional view showing a laser printer according to illustrative aspects of the invention.

A developer cartridge for an image-forming device according to some aspects of the invention will be described while referring to the accompanying drawings wherein like parts and components are designated by the same reference numerals to avoid duplicating description.

1. General Structure of a Laser Printer

FIG. 1 is a side cross-sectional view showing a laser printer 1 according to illustrative aspects of the invention. As shown in FIG. 1, the laser printer 1 includes a main casing 2 and, within the main casing 2, a feeding unit 4 for supplying sheets of a paper 3, and an image-forming unit 5 for forming images on the paper 3 supplied from the feeding unit 4.

(1) Main Casing

As shown in FIG. 1, the laser printer 1 also includes an accommodating section 6 formed in the main casing 2 for accommodating a process cartridge 20 described later, and a front cover 7 disposed on the main casing 2 for opening and closing over the accommodating section 6.

The front cover 7 is rotatably supported by a cover shaft (not shown) inserted through a bottom edge of the front cover 7. The front cover 7 is capable of rotating open and closed about the cover shaft.

In the following description, the right side in FIG. 1 (the side on which the front cover 7 is mounted) will be referred to as the "front side" of the laser printer 1 and while the left side in FIG. 1 will be referred to as the "rear side." Further, the near side in FIG. 1 will be referred to as the "left side," and the far side in FIG. 1 will be referred to as the "right side."

(2) Feeding Unit

The feeding unit 4 includes a paper tray 9 that is detachably mounted in a lower section of the main casing 2, a feeding roller 10 and a separating pad 11 disposed above a front end of the paper tray 9, a pickup roller 12 disposed on the rear side of the feeding roller 10, a pinch roller 13 disposed in opposition to the feeding roller 10 on the lower front side thereof, and a pair of registration rollers 14 disposed on the upper rear side of the feeding roller 10.

A paper-pressing plate 15 is provided inside the paper tray 9 for supporting the paper 3 in a stacked state. The paper-pressing plate 15 is pivotably supported on the rear end thereof, so that the front end can move vertically.

A lever 17 is provided in the front section of the paper tray 9 for lifting the front end of the paper-pressing plate 15. The lever 17 has a substantially L-shaped cross-section in order to bend around the front end of the paper-pressing plate 15 and extend under the bottom surface of the paper-pressing plate 15. The top end of the lever 17 is attached to a lever shaft 18 disposed on the front end of the paper tray 9, while the rear end of the lever 17 contacts the bottom surface of the paper-pressing plate 15 near the front end thereof. When the lever shaft 18 is driven to rotate clockwise in FIG. 1, the lever 17 rotates about the lever shaft 18, and the rear end of the lever 17 lifts the front end of the paper-pressing plate 15.

When the front end of the paper-pressing plate 15 is lifted, the topmost sheet of the paper 3 stacked on the paper-pressing plate 15 is pressed against the pickup roller 12. The pickup roller 12 rotates to begin conveying the topmost sheet of the paper 3 between the feeding roller 10 and the separating pad 11.

However, when the paper tray 9 is removed from the main casing 2, the front end of the paper-pressing plate 15 drops downward of its own accord and rests on the bottom surface of the paper tray 9. In this state, the paper 3 can be supported in a stacked form on the paper-pressing plate 15.

When the pickup roller 12 conveys a sheet of the paper 3 toward a nip part between the feeding roller 10 and the separating pad 11, the paper 3 becomes interposed between the feeding roller 10 and the separating pad 11 by the rotation of the feeding roller 10 and is reliably separated and fed one sheet at a time. The separated sheet of paper 3 is fed between the feeding roller 10 and the pinch roller 13 and conveyed to the registration rollers 14.

After adjusting the registration of the paper 3, the registration rollers 14 convey the sheet of paper 3 to a transfer position in the image-forming unit 5 (a position between a photosensitive drum 92 and a transfer roller 94 described later at which a toner image formed on the photosensitive drum 92 is transferred onto the paper 3).

(3) Image-Forming Unit

The image-forming unit 5 includes a scanning unit 19, the process cartridge 20, and a fixing unit 21.

(a) Scanning Unit

The scanning unit 19 is disposed in the top section of the main casing 2 and includes a laser light source (not shown), a polygon mirror 22 that can be driven to rotate, an fθ lens 23, a reflecting mirror 24, a lens 25, and a reflecting mirror 26. The laser light source emits a laser beam based on image data. As illustrated by a dotted line in FIG. 1, the laser beam is deflected by the polygon mirror 22, passes through the fθ lens 23, is reflected off the reflecting mirror 24, passes through the lens 25, and is further reflected downward by the reflecting mirror 26 and irradiated on the surface of the photosensitive drum 92 described later in the process cartridge 20.

(b) Process Cartridge

The process cartridge 20 is detachably mounted in the accommodating section 6 of the main casing 2 beneath the scanning unit 19. The process cartridge 20 includes a drum cartridge 27, and a developer cartridge 28 that is detachably mounted on the drum cartridge 27.

(b-1) Drum Cartridge

The drum cartridge 27 includes a drum-side casing 76 and, within the drum-side casing 76, the photosensitive drum 92, a Scorotron charger 93, the transfer roller 94, and a cleaning member 95.

The drum-side casing 76 includes a drum accommodating section 102 accommodating the photosensitive drum 92, the charger 93, the transfer roller 94, and the cleaning member 95; and a developer cartridge accommodating section 103 for accommodating a developer cartridge 28.

The drum accommodating section 102 is formed substantially in a box shape that opens on the front side. While not shown in the drawings, the developer cartridge accommodating section 103 is formed continuously from the front end of the drum accommodating section 102. The developer cartridge accommodating section 103 is formed in the shape of a rectangular frame having a bottom and an open top.

The photosensitive drum 92 includes a main drum body 85 that is cylindrical in shape and has a positive charging photosensitive layer formed of polycarbonate on its outer surface, and a metal drum shaft 86 extending through the axial center of the main drum body 85. The drum shaft 86 is supported in the drum accommodating section 102, and the main drum body 85 is rotatably supported relative to the drum shaft 86. With this construction, the photosensitive drum 92 is disposed in the drum accommodating section 102 and is capable of rotating about the drum shaft 86. Further, the photosensitive drum 92 is driven to rotate by a driving force inputted from a motor (not shown).

The charger 93 is supported in the drum accommodating section 102 diagonally above and rearward of the photosensitive drum 92. The charger 93 is disposed in opposition to the photosensitive drum 92 but separated a prescribed distance from the photosensitive drum 92 so as not to contact the same. The charger 93 includes a discharge wire 87 disposed in opposition to but separated a prescribed distance from the photosensitive drum 92, and a grid 88 provided between the discharge wire 87 and the photosensitive drum 92 for controlling the amount of corona discharge from the discharge wire 87 that reaches the photosensitive drum 92.

By applying a high voltage to the discharge wire 87 for generating a corona discharge from the discharge wire 87 at the same time a bias voltage is applied to the grid 88, the charger 93 having this construction can charge the surface of the photosensitive drum 92 with a uniform positive polarity.

The transfer roller 94 is disposed in the drum accommodating section 102 below the photosensitive drum 92 and opposes and contacts the photosensitive drum 92 in a vertical direction from the bottom thereof so as to form a nip part with the photosensitive drum 92. Here, the nip part serves as the transfer position. The transfer roller 94 is configured of a metal roller shaft that is covered with a roller formed of an electrically conductive rubber material. During a transfer operation, a transfer bias is applied to the transfer roller 94. The transfer roller 94 is also driven to rotate by a driving force inputted from a motor (not shown).

The cleaning member 95 is mounted in the drum accommodating section 102 so as to oppose and contact the photosensitive drum 92 from the rear side thereof.

(b-2) Developer Cartridge

The developer cartridge 28 is detachably mounted in the developer cartridge accommodating section 103 of the drum-side casing 76. Hence, when the process cartridge 20 is mounted in the accommodating section 6 of the main casing 2, the developer cartridge 28 can also be mounted in the accommodating section 6 of the main casing 2 by first opening the front cover 7 with the developer cartridge 28 inserted into the developer cartridge accommodating section 103 of the process cartridge 20.

Figure 2:
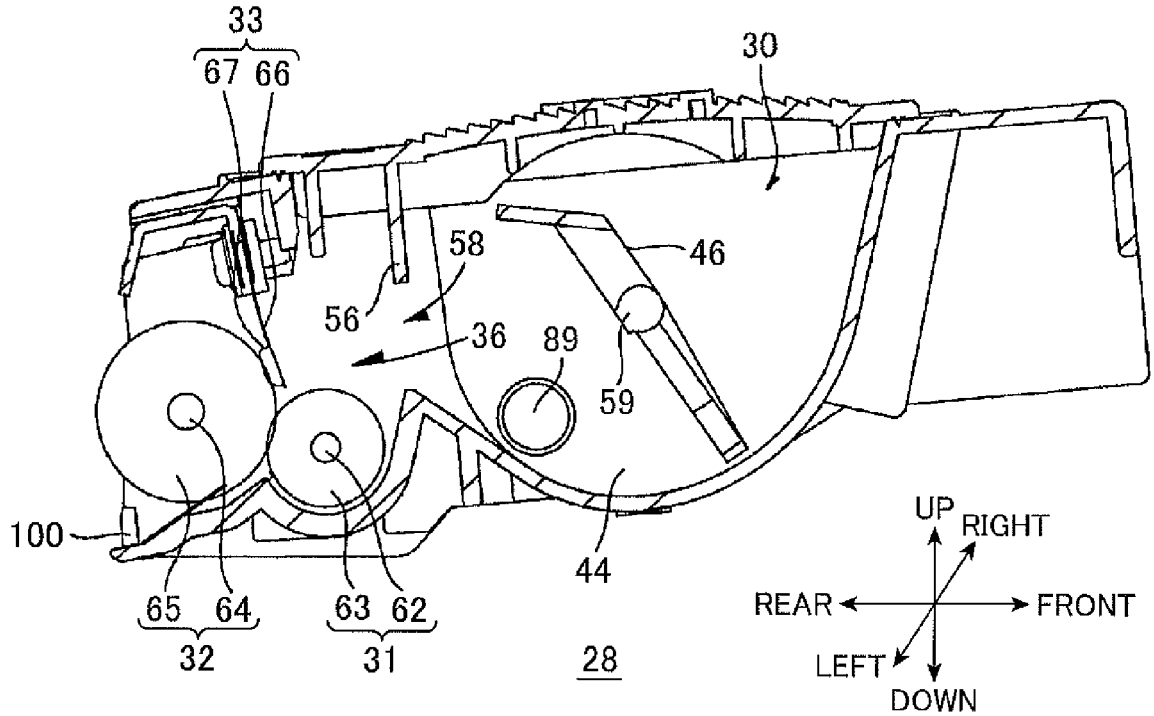
FIG. 2 is a side cross-sectional view of a developer cartridge shown in FIG. 1.

As shown in FIG. 2, the developer cartridge 28 includes a casing 100 and, within the casing 100, a supply roller 31, a developing roller 32, and a thickness-regulating blade 33.

The casing 100 has a box shape that is open on the rear side. A partitioning plate 56 is provided midway in the casing 100 in the front-to-rear direction for partitioning the interior of the casing 100. An opening 58 is formed below the partitioning plate 56 to provide communication between the partitioned sides of the casing 100. The front region of the casing 100 partitioned by the partitioning plate 56 serves as a toner-accommodating chamber 30 for accommodating toner, while the rear region of the casing 100 partitioned by the partitioning plate 56 serves as a developing chamber 36 in which are provided the supply roller 31, the developing roller 32, and the thickness-regulating blade 33.

The toner-accommodating chamber 30 is filled with a non-magnetic, single-component toner having a positive charge. The toner used is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

An agitator rotational shaft 59 is disposed in the center of the toner-accommodating chamber 30. The agitator rotational shaft 59 is rotatably supported in side walls 44 of the casing 100 (see FIG. 3). The side walls 44 confront each other in a width direction of the casing 100 (a direction orthogonal to the front-to-rear direction and the vertical direction). An agitator 46 is disposed on the agitator rotational shaft 59. The agitator 46 is driven to rotate by a driving force inputted into the agitator rotational shaft 59 from a motor (not shown).

Toner detection windows 89 are provided in both side walls 44 of the casing 100 at positions corresponding to the toner-accommodating chamber 30 for detecting the amount of toner remaining in the toner-accommodating chamber 30. The toner detection windows 89 oppose each other in the width direction across the toner-accommodating chamber 30. A toner sensor (not shown) having a light-emitting element and a light-receiving element is disposed in the main casing 2. The light-emitting element (not shown) is provided on the main casing 2 outside one of the toner detection windows 89, while the light-receiving element (not shown) is provided on the main casing 2 outside the other of the toner detection windows 89. Light emitted from the light-emitting element passes into the toner-accommodating chamber 30 through one of the toner detection windows 89. The light-receiving element detects this light as a detection light when the light passes through the toner-accommodating chamber 30 and exits the other toner detection windows 89. The toner sensor determines the amount of remaining toner based on the frequency that the light-receiving element detects this detection light. When the toner sensor determines that the amount of toner remaining in the toner-accommodating chamber 30 has dropped to a low level, the laser printer 1 displays an out-of-toner warning on a control panel or the like (not shown).

The supply roller 31 is disposed rearward of the opening 58 and includes a metal supply roller shaft 62 covered by a sponge roller 63 formed of an electrically conductive foam material. The supply roller shaft 62 is rotatably supported in both side walls 44 of the casing 100 at a position corresponding to the developing chamber 36. The supply roller 31 is driven to rotate by a driving force inputted into the supply roller shaft 62 from a motor (not shown).

The developing roller 32 is disposed rearward of the supply roller 31 and contacts the supply roller 31 with pressure so that both are compressed. The developing roller 32 includes a metal developing roller shaft 64, and a rubber roller 65 formed of an electrically conductive rubber material that covers the developing roller shaft 64. The developing roller shaft 64 is rotatably supported in both side walls 44 of the casing 100 at a position corresponding to the developing chamber 36. The rubber roller 65 is more specifically formed of an electrically conductive urethane rubber or silicon rubber containing fine carbon particles or the like, the surface of which is coated with urethane rubber or silicon rubber containing fluorine. The developing roller 32 is driven to rotate by a driving force inputted into the developing roller shaft 64 from a motor (not shown). During a developing operation, a developing bias is applied to the developing roller 32.

The thickness-regulating blade 33 includes a main blade member 66 configured of a metal leaf spring member, and a pressing part 67 provided on a distal end of the main blade member 66. The pressing part 67 has a semicircular cross section and is formed of an insulating silicon rubber. A base end of the main blade member 66 is supported on the casing 100 above the developing roller 32 so that the elastic force of the main blade member 66 causes the pressing part 67 to contact the surface of the developing roller 32 with pressure.

(b-3) Developer Transferring Operation

When a motor (not shown) inputs a driving force into the agitator rotational shaft 59, the agitator rotational shaft 59 begins rotating clockwise in FIG. 1. At this time, the agitator 46 moves circularly in the toner-accommodating chamber 30 about the agitator rotational shaft 59, thereby agitating toner in the toner-accommodating chamber 30 and discharging some of the toner into the developing chamber 36 through the opening 58.

Toner discharged through the opening 58 is supplied onto the developing roller 32 by the rotating supply roller 31. At this time, the toner is positively tribocharged between the supply roller 31 and the developing roller 32. As the developing roller 32 rotates, the toner supplied to the surface of the developing roller 32 passes between the pressing part 67 of the thickness-regulating blade 33 and the rubber roller 65 of the developing roller 32, thereby maintaining a thin layer of uniform thickness on the surface of the developing roller 32.

As the photosensitive drum 92 rotates, the charger 93 charges the surface of the photosensitive drum 92 with a uniform positive polarity. Subsequently, a laser beam emitted from the scanning unit 19 is scanned at a high speed over the surface of the photosensitive drum 92, forming an electrostatic latent image corresponding to an image to be formed on the paper 3.

Next, positively charged toner carried on the surface of the developing roller 32 comes into contact with the photosensitive drum 92 as the developing roller 32 rotates and is supplied to areas on the surface of the positively charged photosensitive drum 92 that were exposed to the laser beam and, therefore, have a lower potential. In this way, the latent image on the photosensitive drum 92 is transformed into a visible image according to a reverse development process so that a toner image is carried on the surface of the photosensitive drum 92.

As the registration rollers 14 convey a sheet of the paper 3 through the transfer position between the photosensitive drum 92 and the transfer roller 94, the toner image carried on the surface of the photosensitive drum 92 is transferred onto the paper 3 by a transfer bias applied to the transfer roller 94. After the toner image is transferred, the paper 3 is conveyed to the fixing unit 21.

Toner remaining on the photosensitive drum 92 after the transfer operation is recovered by the developing roller 32. Further, paper dust deposited on the photosensitive drum 92 from the paper 3 during the transfer operation is recovered by the cleaning member 95.

(c) Fixing Unit

The fixing unit 21 is disposed on the rear side of the process cartridge 20 and includes a fixed frame 57, and a heating roller 54 and a pressure roller 55 provided within the fixed frame 57.

The heating roller 54 includes a metal tube, the surface of which has been coated with a fluorine resin, and a halogen lamp disposed inside the metal tube for heating the same. The heating roller 54 is driven to rotate by a driving force inputted from a motor (not shown).

The pressure roller 55 is disposed below and in opposition to the heating roller 54 and contacts the heating roller 54 with pressure. The pressure roller 55 is configured of a metal roller shaft covered with a roller that is formed of a rubber material. The pressure roller 55 follows the rotational drive of the heating roller 54.

In the fixing unit 21, a toner image transferred onto the paper :3 at the transfer position is subsequently fixed to the paper 3 by heat as the paper 3 passes between the heating roller 54 and the pressure roller 55. After the toner image is fixed to the paper 3, the heating roller 54 and the pressure roller 55 continue to convey the paper 3 along a discharge path 60 extending upward toward the top surface of the main casing 2. Discharge rollers 61 provided at the top of the discharge path 60 discharge the paper onto a discharge tray 53 formed on the top surface of the main casing 2.

Figure 3:
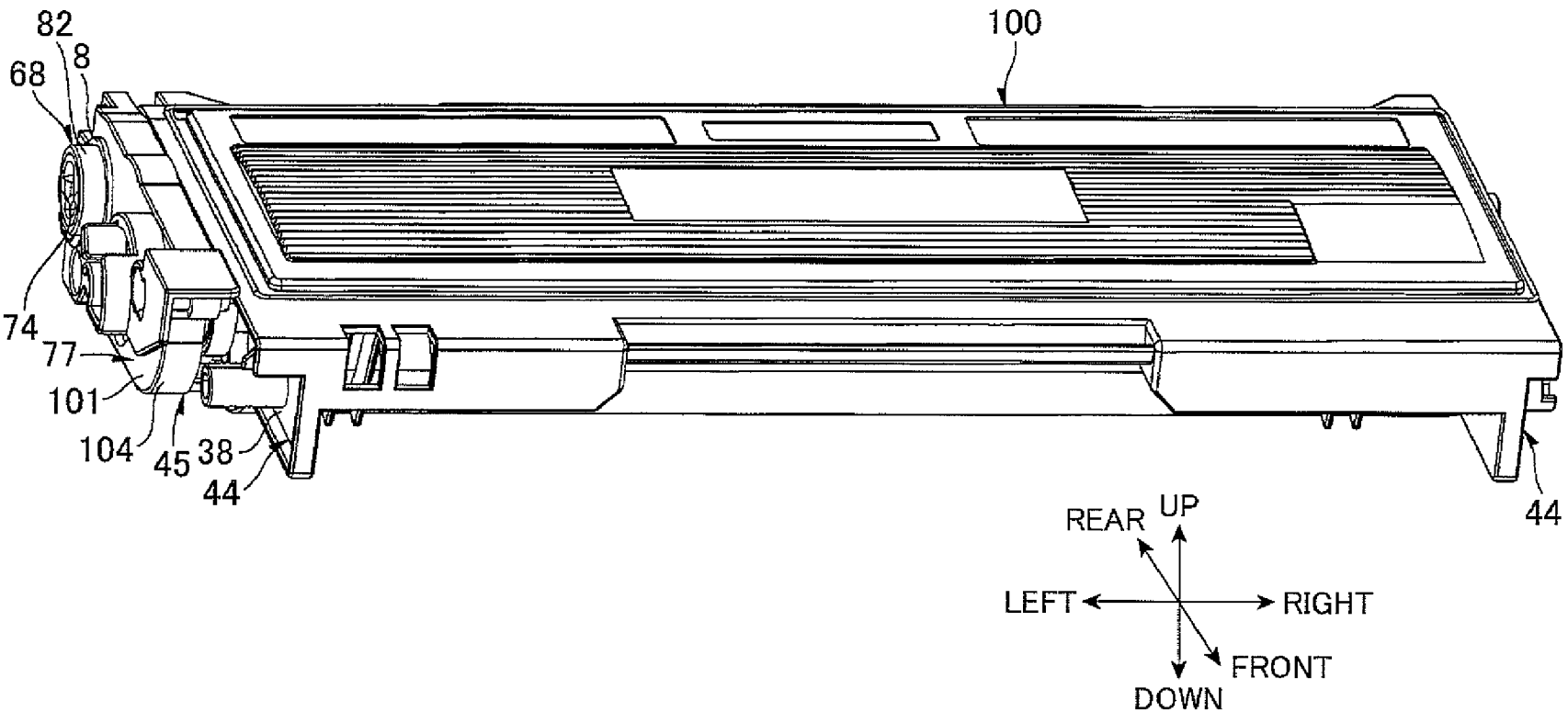
FIG. 3 is a perspective view from the upper front side of the developer cartridge shown in FIG. 2.
Figure 4:
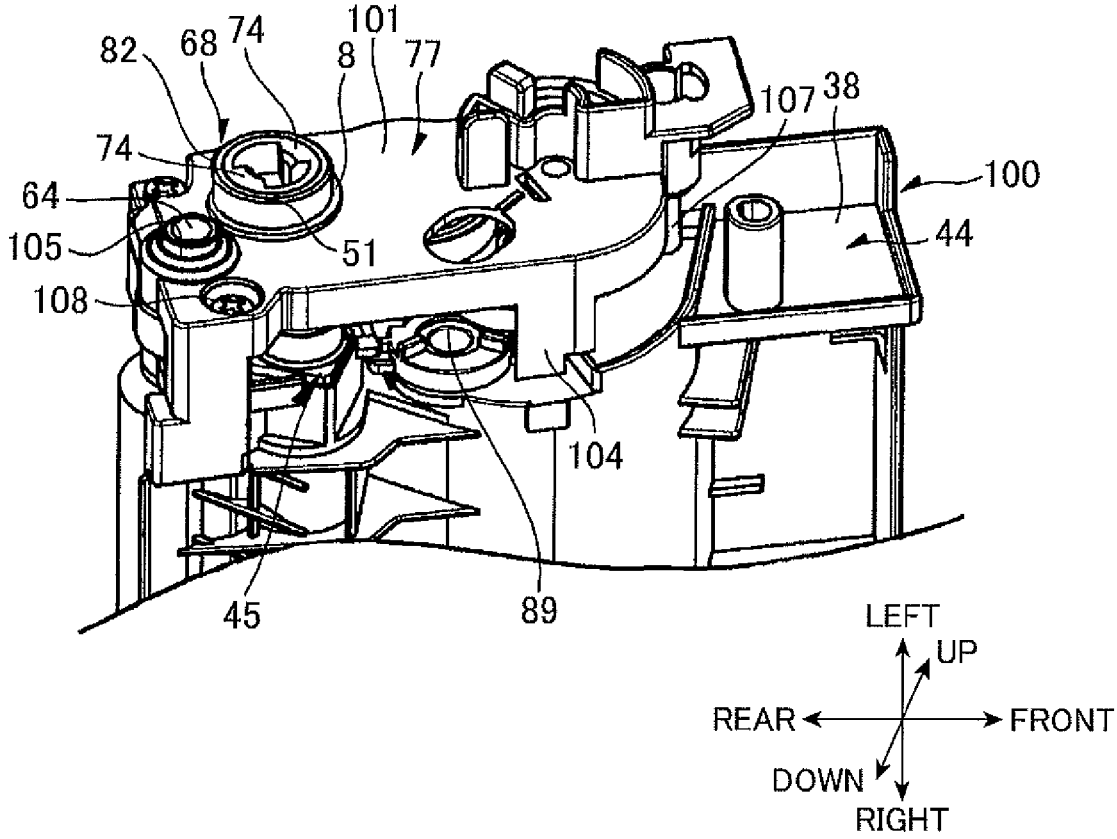
FIG. 4 is a perspective view from the lower left side of the developer cartridge shown in FIG. 2.

2. Construction Related to Mounting the Developer Cartridge in the Main Casing (a) Structure of the Developer Cartridge FIG. 3 is a perspective view of the developer cartridge 28 as viewed from the upper front side shown in FIG. 2. FIG. 4 is a perspective view from the lower left side of the developer cartridge 28.

As shown in FIG. 3, the casing 100 of the developer cartridge 28 includes the pair of side walls 44 opposing and separate from each other in the width direction. A gear mechanism 45, and a gear cover 77 for covering the gear mechanism 45 are disposed on the left side wall 44 (hereinafter referred to as the "left side wall 38").

Figure 5A:
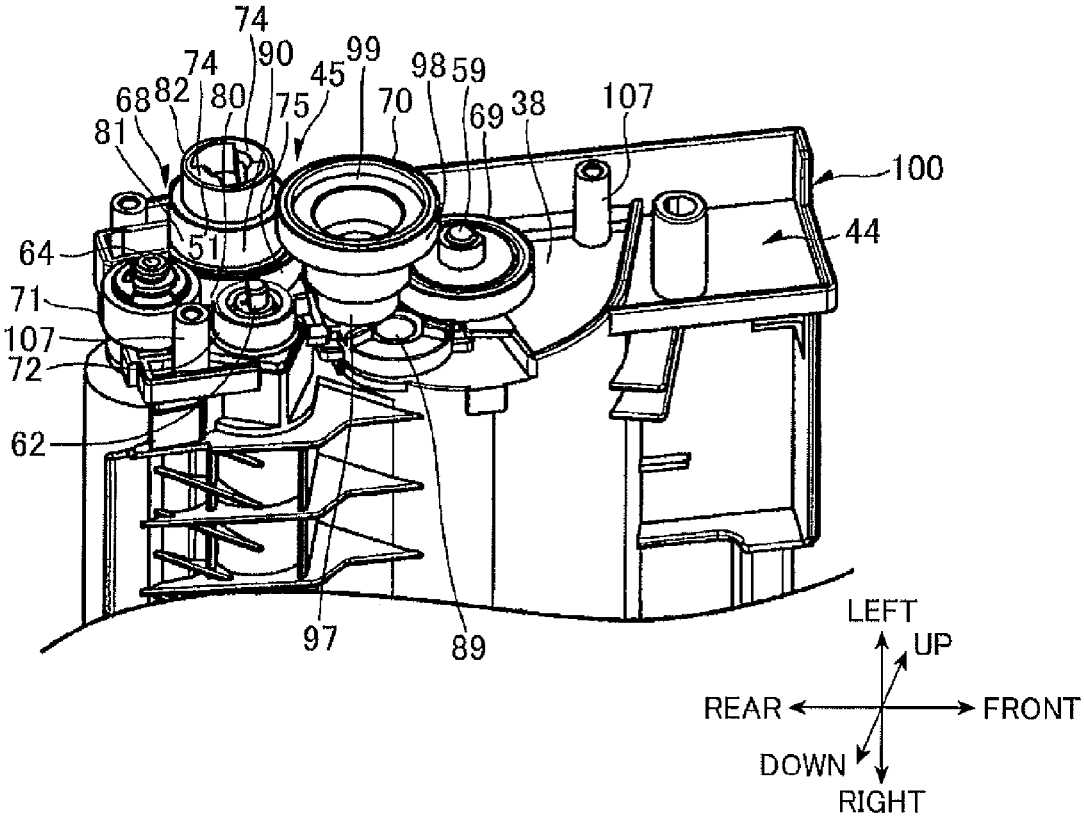
FIG. 5(*a*) is a perspective view from the lower left side of the developer cartridge when a gear cover has been removed.
Figure 5B:
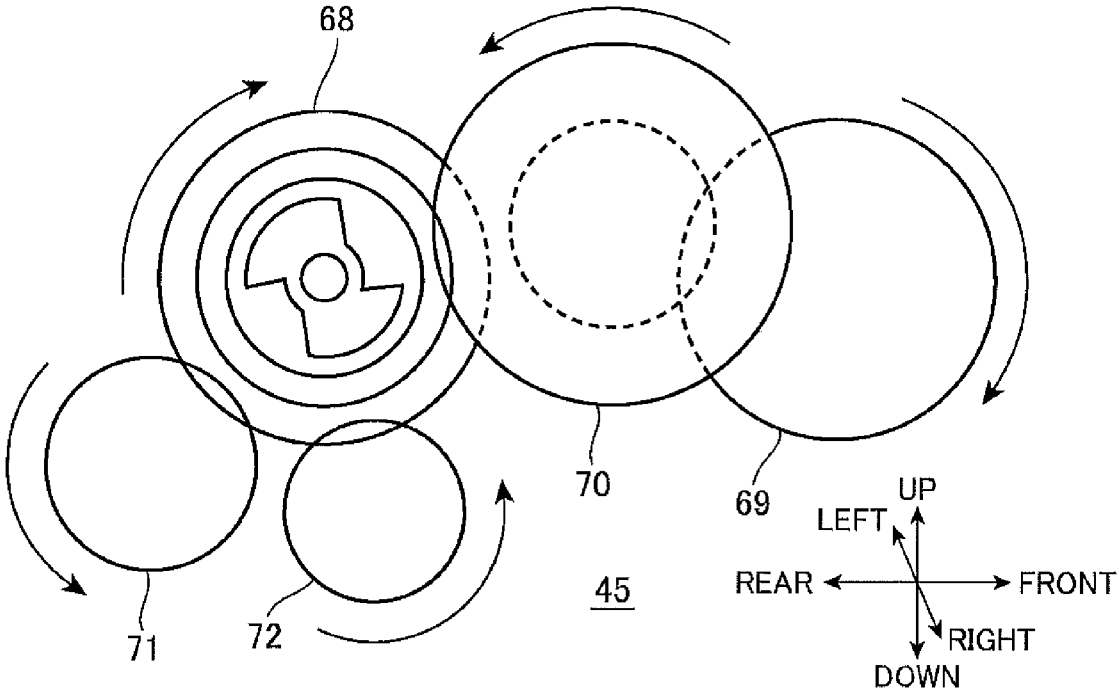

The gear mechanism 45 is provided for inputting a rotational drive force into the developing roller 32, the supply roller 31, and the agitator 46. As shown in FIG. 5(*a*), the gear mechanism 45 includes an input gear 68 for receiving a driving force from a driving gear 73 described later, an intermediate gear 70 that is engaged with the input gear 68, an agitator drive gear 69 that is engaged with the intermediate gear 70, a developing roller drive gear 71 that is engaged with the input gear 68, and a supply roller drive gear 72 that is also engaged with the input gear 68. As shown in FIG. 5(*b*), the input gear 68 rotates clockwise by the driving force. Thus, this rotation of the input gear 68 makes the intermediate gear 70, the developing roller drive gear 71, and the supply roller drive gear 72 rotate counterclockwise. Engaging with the intermediate gear 70, the agitator drive gear 69 rotates clockwise.

Figure 6A:
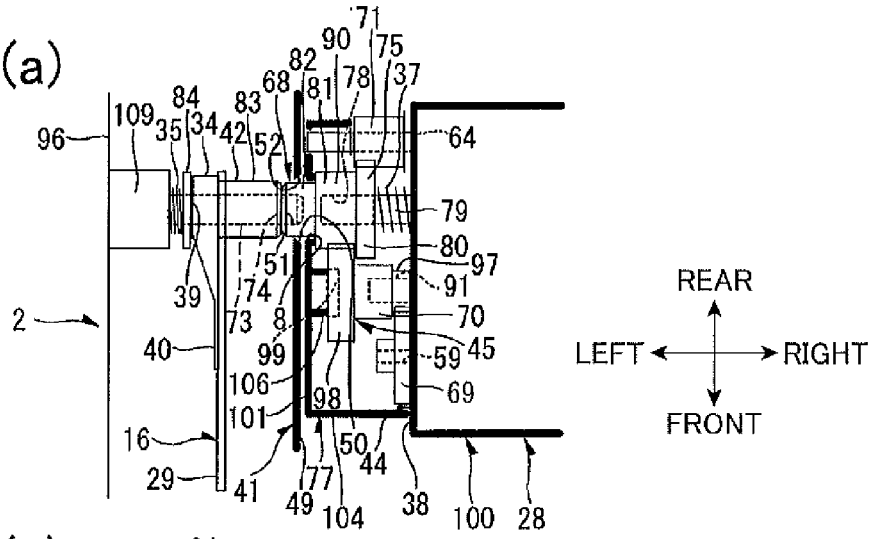
FIG. 6(*a*) is a schematic diagram showing a state in which the developer cartridge opposes a first wall part and a driving gear is engaged with an input gear.
Figure 6B:
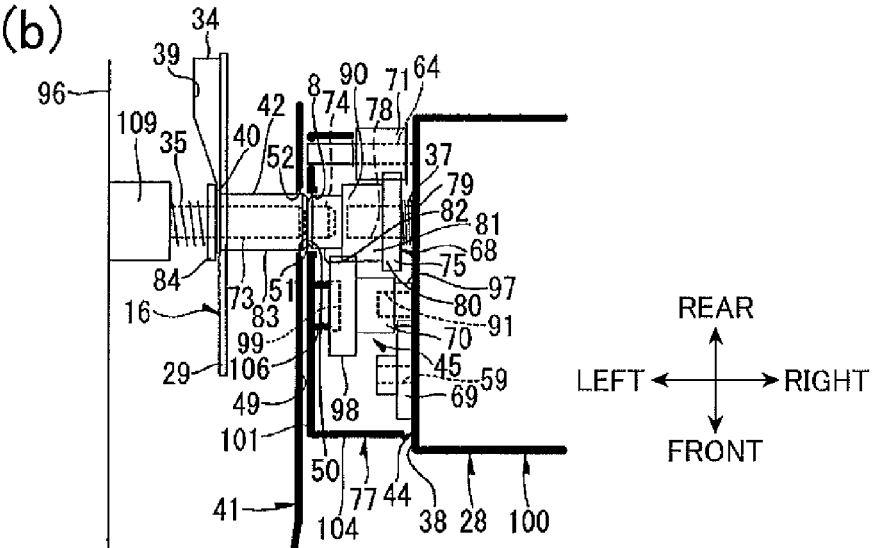
Figure 6C:
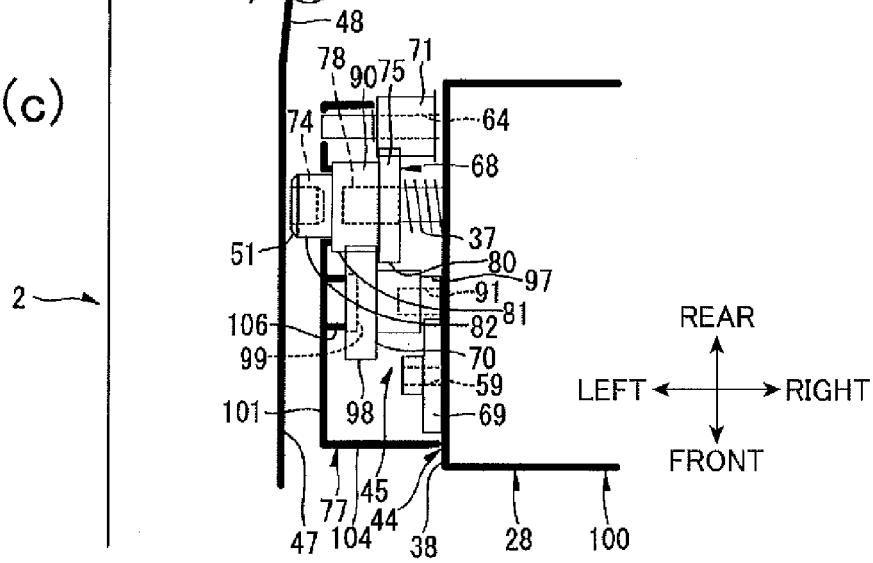

As shown in FIG. 6(*a*), an input gear support shaft 79 protrudes leftward from the rear side of the left side wall 38. The input gear 68 is rotatably supported on an input gear support shaft 79 and is capable of sliding over the input gear support shaft 79 in the axial direction.

The input gear 68 is integrally formed of three gears with differing diameters that grow gradually smaller from the right side (base end) of the input gear 68 to the left side (free end). Specifically, the input gear 68 is integrally formed of an inner gear 80 disposed on the base end, a coupling gear 82 disposed on the free end, and an outer gear 81 disposed between the inner gear 80 and the coupling gear 82.

The inner gear 80 is disc-shaped and has inner teeth 75 formed on the outer periphery thereof. The outer gear 81 is provided coaxially with the inner gear 80. The outer gear 81 is disc-shaped and has a smaller diameter and a thicker axial dimension than the inner gear 80. Outer teeth 90 are formed on the outer periphery of the outer gear 81.

The coupling gear 82 is disposed coaxially with the inner gear 80 and the outer gear 81. The coupling gear 82 is cylindrical in shape with a smaller diameter and a thinner axial dimension than the outer gear 81, and a smaller diameter and a thicker axial dimension than the inner gear 80. A pair of keys 74 is formed on the inner peripheral surface of the coupling gear 82 and protrudes radially inward. The keys 74 protrude toward each other from positions displaced 180° around the inner peripheral surface of the coupling gear 82.

Figure 7:
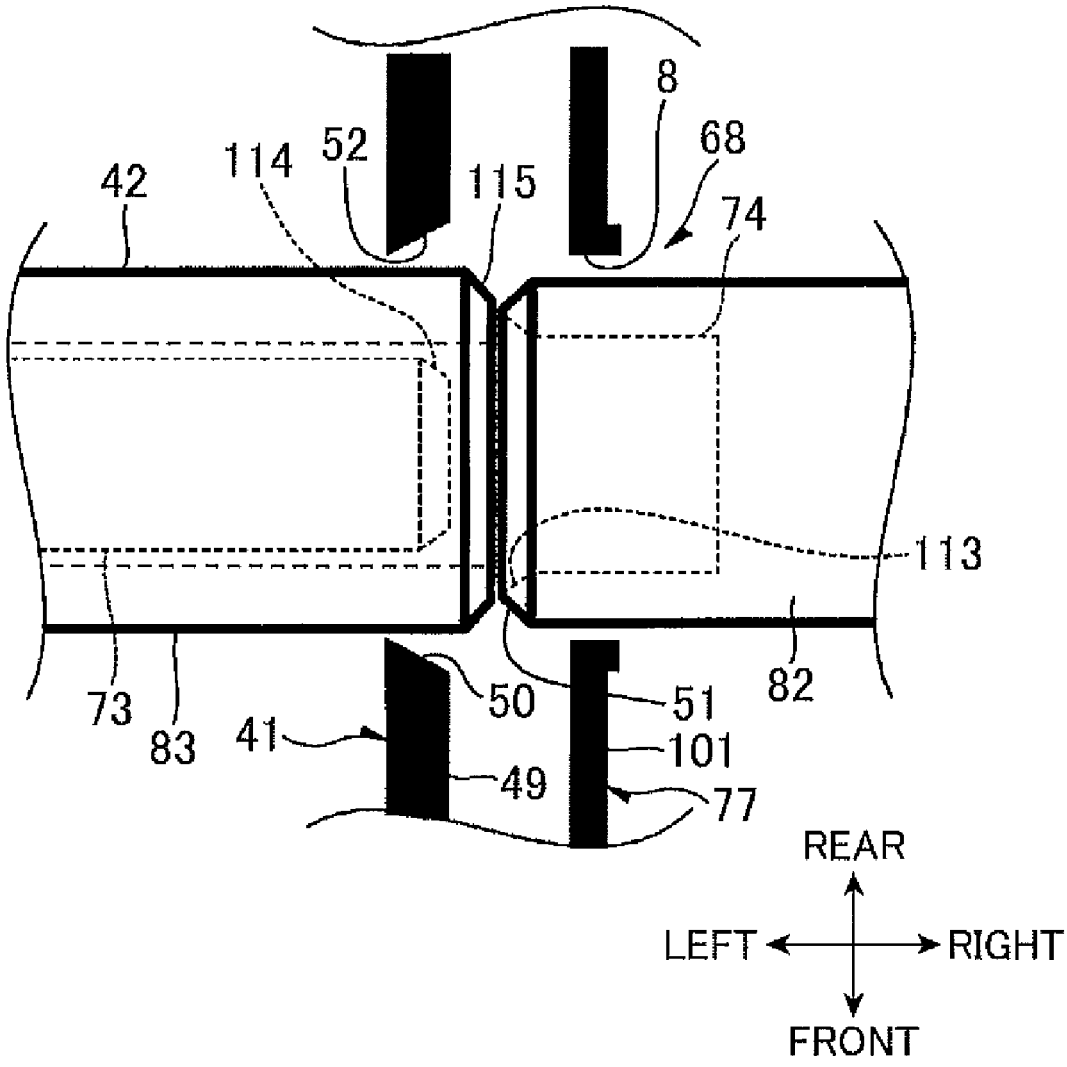
FIG. 7 is an enlarged view illustrating the state of contact between the collar and the input gear in FIG. 6(*b*)

As shown in FIG. 7, gear-side sloped surface 51 is formed on the free end of the coupling gear 82 as a chamfered surface connecting the endface to the outer peripheral surface thereof. A key-side sloped surface 113 is formed on the free end of the coupling gear 82 as a chamfered surface connecting the endface to the inner peripheral surface thereof.

As shown in FIG. 6(*a*), a shaft insertion recess 78 is formed in the input gear 68 from the inner gear 80 to the outer gear 81 for inserting the input gear support shaft 79.

By inserting the input gear support shaft 79 into the shaft insertion recess 78, the input gear 68 is rotatably supported on the input gear support shaft 79 and is capable of sliding in the axial direction of the input gear support shaft 79. As will be described later, the input gear 68 is guided along the input gear support shaft 79 in the axial direction (that is, the left-to-right direction) while the inner teeth 75 are engaged with the developing roller drive gear 71 and the supply roller drive gear 72 and while the outer teeth 90 are engaged with the intermediate gear 70.

A coil spring 37 is fitted over the input gear support shaft 79. The coil spring 37 extends along the axis of the input gear support shaft 79 and is interposed between the left side wall 38 and the input gear 68. The coil spring 37 is configured of a compression spring. The right end of the coil spring 37 contacts the left side wall 38, and the left end contacts the right endface of the inner gear 80 provided in the input gear 68 for constantly urging the input gear 68 in an advancing direction of the input gear 68 (leftward or outward in the width direction) described later.

As shown in FIG. 5(*a*) and 6(*a*), the intermediate gear 70 is rotatably supported on an intermediate gear support shaft 91 that protrudes leftward from the left side wall 38 at a position in front of the input gear 68. The intermediate gear 70 is integrally configured of an inner gear 97 provided on the right axial side (base end) and an outer gear 98 provided on the left axial end (free end) and having a larger diameter than that of the inner gear 97. The outer gear 98 of the intermediate gear 70 is engaged with the outer gear 81 of the input gear 68. A recessed support part 99 is formed in the left endface of the outer gear 98.

The agitator drive gear 69 is provided on the left axial end of the agitator rotational shaft 59 and is incapable of rotating relative to the agitator rotational shaft 59. The agitator rotational shaft 59 protrudes leftward from the left side wall 38 at a position diagonally forward and below the intermediate gear 70 and penetrates the left side wall 38. The agitator drive gear 69 is engaged with the inner gear 97 of the intermediate gear 70.

The developing roller drive gear 71 is provided on the left axial end of the developing roller shaft 64 and is incapable of rotating relative to the developing roller shaft 64. The developing roller shaft 64 protrudes leftward from the left side wall 38 at a position diagonally below and rearward of the input gear 68 and penetrates the left side wall 38. The developing roller drive gear 71 is engaged with the inner gear 80 of the input gear 68.

As shown in FIG. 5(*a*), the supply roller drive gear 72 is provided on the left axial end of the supply roller shaft 62 and is incapable of rotating relative to the supply roller shaft 62. The supply roller shaft 62 protrudes leftward from the left side wall 38 at a position below the input gear 68 and penetrates the left side wall 38. The supply roller drive gear 72 is separated from the developing roller drive gear 71 and is engaged with the inner gear 80 of the input gear 68.

As shown in FIGS. 3 and 4, the gear cover 77 is mounted on the left side wall 38 for covering the gear mechanism 45. In other words, the gear cover 77 covers the input gear 68, the intermediate gear 70, the agitator drive gear 69, the developing roller-drive gear 71, and the supply roller drive gear 72.

The gear cover 77 is integrally configured of a cover plate 101 and a foot part 104. The cover plate 101 is disposed on the outer widthwise side (left side) of the left side wall 38 with the gear mechanism 45 interposed therebetween. The foot part 104 is bent from the peripheral edge of the cover plate 101 toward the left side wall 38.

A coupling insertion hole 8 is formed in the cover plate 101 at a position opposing the coupling gear 82 of the input gear 68 as an opening for inserting the coupling gear 82. The coupling insertion hole 8 has a diameter greater than the coupling gear 82 but smaller than the outer gear 81 of the input gear 68 for allowing advancing and retracting of the coupling gear 82.

As shown in FIG. 7, the peripheral edge of the coupling insertion hole 8 protrudes slightly inward (rightward) from the inner surface (right surface) of the cover plate 101 since the outer peripheral edge on the right endface of the outer gear 81 contact the same, as will be described later.

As shown in FIG. 4, a developing roller shaft insertion hole 105 is formed in the cover plate 101 at a position corresponding to the developing roller shaft 64. The developing roller shaft insertion hole 105 enables the left axial end of the developing roller shaft 64 that penetrates through the developing roller drive gear 71 to protrude outward in the width direction (leftward) from the gear cover 77.

As shown in FIG. 6(*a*), a cylindrical part 106 is formed on the inner surface of the cover plate 101 for being inserted into the recessed support part 99 of the intermediate gear 70.

As shown in FIG. 5(*a*), boss parts 107 are provided on the left side wall 38 at positions below the developing roller drive gear 71 and in front of the agitator drive gear 69. The boss parts 107 protrude leftward from the left side wall 38. Screws 108 (FIG. 4) are screwed into the boss parts 107.

As shown in FIG. 4, the gear cover 77 is mounted on the left side wall 38 by placing the free end (right endface) of the foot part 104 into contact with the left side wall 38 so that the gear cover 77 covers the input gear 68, the intermediate gear 70, the agitator drive gear 69, the developing roller drive gear 71, and the supply roller drive gear 72 and by inserting the coupling gear 82 into the coupling insertion hole 8, the developing roller shaft 64 into the developing roller shaft insertion hole 105, and the cylindrical part 106 into the recessed support part 99 of the intermediate gear 70 (see FIG. 6(*a*)). Subsequently, the screws 108 are inserted through the cover plate 101 and screwed into the boss parts 107.

With this construction, the gear cover 77 protects the input gear 68 by covering the inner gear 80 and the outer gear 81 with the cover plate 101, while allowing the coupling gear 82 to protrude outward in the width direction (leftward) from the coupling insertion hole 8.

As shown in FIGS. 6(*a*) and 6(*c*), the coil spring 37 interposed between the left side wall 38 and the input gear 68 constantly urges the input gear 68 in the advancing direction of the input gear 68 (leftward or outward in the width direction). Accordingly, the outer peripheral edge of the outer gear 81 on the left endface thereof is usually in contact with the peripheral edge of the coupling insertion hole 8 formed in the cover plate 101. This restricts further movement of the input gear 68 in the advancing direction of the input gear 68 and maintains the input gear 68 at an advanced position, that is the furthest point in the advancing direction of the input gear 68. When the input gear 68 is in this advanced position, the input gear 68 can engage with the driving gear 73 as will be described later (see FIG. 6(*a*)).

However, if the input gear 68 is pressed inward (rightward) in the width direction against the urging force of the coil spring 37, the input gear 68 moves in a retracting direction of the input gear 68 (rightward or inward in the width direction) to a retracted position shown in FIG. 6(*b*). When the input gear 68 is retracted to the retracted position, only the left endface and the gear-side sloped surface 51 of the coupling gear 82 are exposed through the coupling insertion hole 8 in the gear cover 77.

As shown in FIGS. 6(*a*) and 6(*b*), the inner teeth 75 of the input gear 68 are fully engaged with the developing roller drive gear 71 and the supply roller drive gear 72 (FIG. 5(*a*)), whether the input gear 68 is in the advanced position (FIG.

6(*a*)) or the retracted position (FIG. 6(*b*)). Hence, the area of engagement between the inner teeth 75 and the developing roller drive gear 71 and the supply roller drive gear 72 does not change. On the other hand, the outer teeth 90 of the input gear 68 and the outer gear 98 of the intermediate gear 70 are fully engaged when the input gear 68 is in the advanced position (FIG. 6(*a*)). However, only approximately the right half of the outer gear 98 of the intermediate gear 70 is engaged with the outer teeth 90 when the input gear 68 is in the retracted position (FIG. 6(*b*)). Therefore, the area of engagement between the outer teeth 90 and the intermediate gear 70 increases when the input gear 68 is moved from the retracted position to the advanced position. Accordingly, the total area of engagement between the intermediate gear 70, the supply roller drive gear 72, and the developing roller drive gear 71 and the input gear 68 increases when the input gear 68 is moved from the retracted position to the advanced position.

(b) Structure of the Main Casing

The accommodating section 6 of the main casing 2 (see FIG. 1) includes a left wall 96 (see FIG. 6(*a*)) and a right wall (not shown) separated a distance in the width direction.

As shown in FIG. 6(*b*) and 6(*c*), a guide wall 41 is provided on the inner side (right side) of the left wall 96 and is separated a prescribed distance from the left wall 96 in the width direction. In a plan view, the guide wall 41 includes, in the range that the developer cartridge 28 moves in the front-to-rear direction during mounting or removal, a second wall part 47 (FIG. 6(*c*)) that extends parallel to the mounting direction of the developer cartridge 28 (rearward direction) from the front of the main casing 2, a third wall part. 48 (FIG. 6(*c*)) continuing from the rear edge of the second wall part 47 and sloping inward (rightward) in the width direction, and a first wall part 49 (FIG. 6(*b*)) continuing from the rear edge of the third wall part 48 and extending parallel to the second wall part 47.

As shown in FIG. 6(*b*), a through-hole 50 is formed in the first wall part 49 at a position confronting a collar 42 and the driving gear 73 inserted into the collar 42. As shown in FIG. 7, a hole-side sloped surface 52 is formed along the edge of the through-hole 50 as a chambered surface that grows gradually larger in diameter from the left side surface to the right side surface of the guide wall 41.

As shown in FIG. 6(*b*), disposed between the left wall 96 and the guide wall 41 in the width direction are the driving gear 73, the collar 42 for coupling and uncoupling the driving gear 73 and the input gear 68, and a translation arm 16 for advancing and retracting the collar 42.

The driving gear 73 is disposed opposite the first wall part 49 in the width direction. A base end of the driving gear 73 is rotatably supported in a gear box 109 disposed on the left wall 96. The free end of the driving gear 73 protrudes inward in the width direction (rightward). The driving gear 73 is driven to rotate about its axis by a driving force inputted from a motor (not shown) provided in the main casing 2.

The free end of the driving gear 73 confronts the through-hole 50 formed in the first wall part 49. As will be described later, when the developer cartridge 28 is mounted in the main casing 2, the free end of the driving gear 73 is positioned between the first wall part 49 and the cover plate 101.

As shown in FIG. 7, a drive-gear-side sloped surface 114 is formed on the free end of the driving gear 73 as a chambered surface connecting the endface to the outer peripheral surface of the driving gear 73.

As shown in FIG. 6(*a*), the collar 42 is integrally provided with a cylindrical collar member 83, and a flange part 84 that extends radially outward and is disposed on the left edge of the cylindrical collar member 83. The collar 42 is fitted over the driving gear 73 so as to be capable of sliding in the axial direction of the driving gear 73.

As shown in FIG. 7, a collar-side sloped surface 115 is formed on the right side of the cylindrical collar member 83 as a chambered surface connecting the endface to the outer peripheral surface of the cylindrical collar member 83.

As shown in FIG. 6(*a*), a coil spring 35 is interposed between the left wall 96 and the collar 42. The coil spring 35 is fitted over the driving gear 73 along the axial direction thereof. The coil spring 35 is configured of a compression spring. The right end of the coil spring 35 contacts the flange part 84, while the left end contacts the gear box 109 on the left wall 96 for constantly urging the collar 42 in an advancing direction of the collar 42 (rightward or inward in the width direction).

Figure 8B:
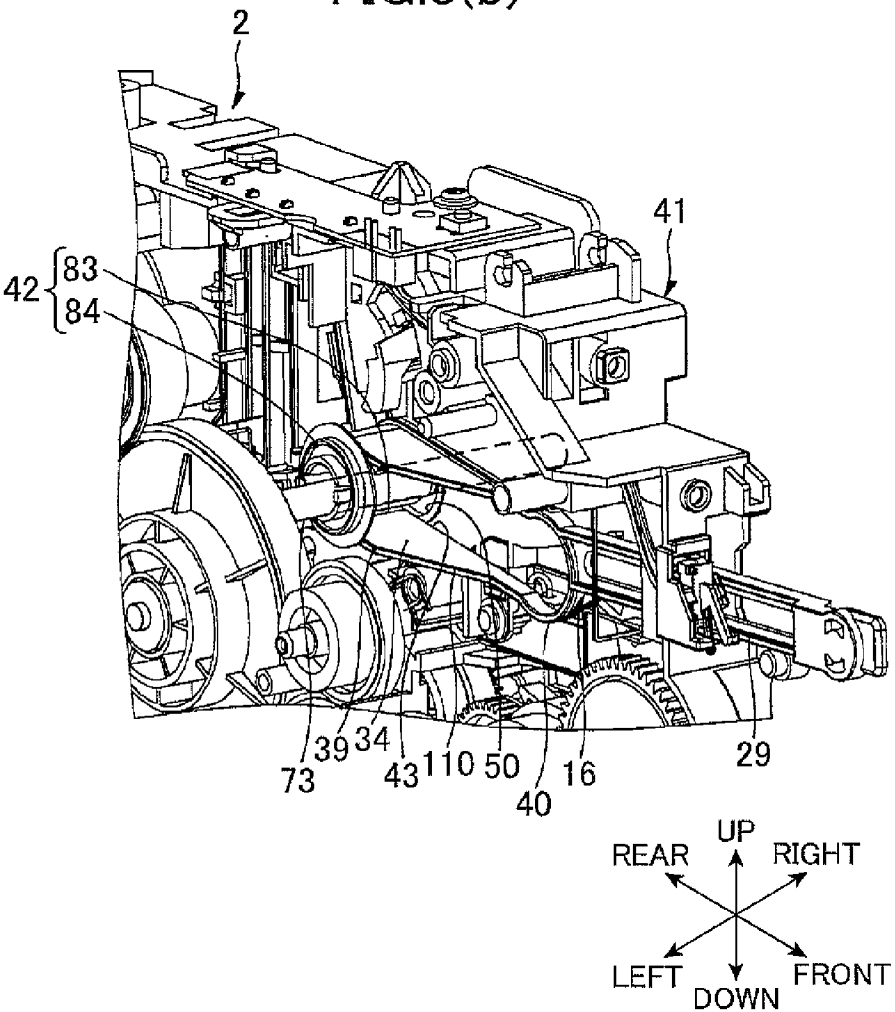
FIG. 8(*a*) is a perspective diagram showing a front cover in an open state.
Figure 8A:
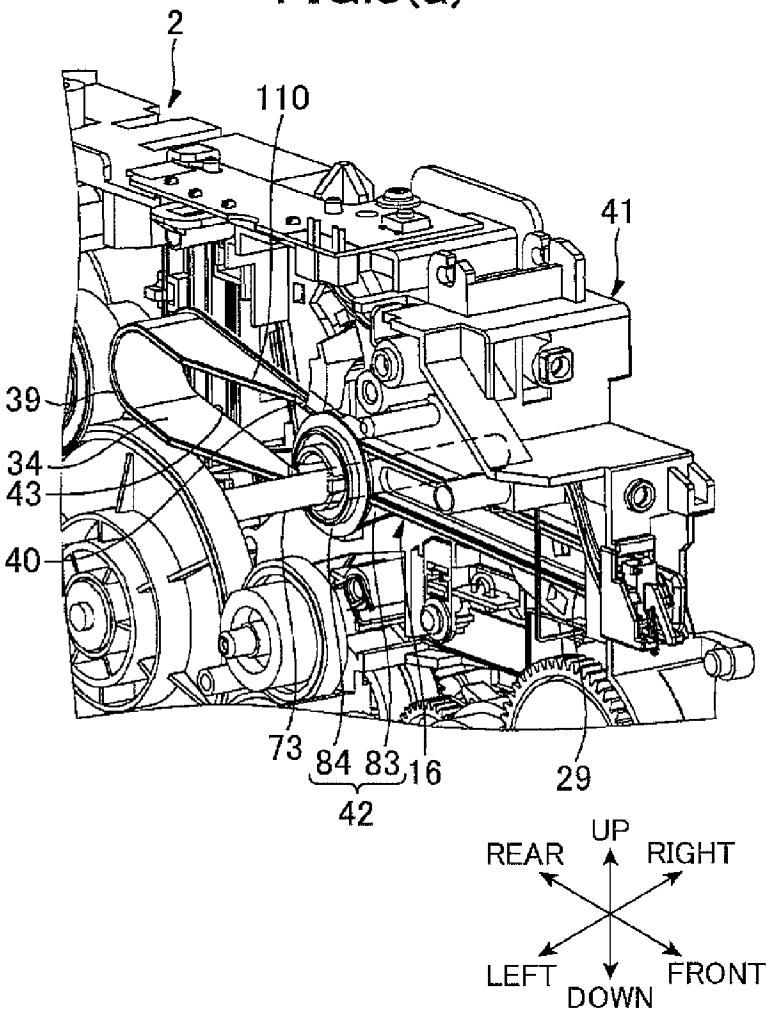

As shown in FIGS. 8(*a*) and 8(*b*), the translation arm 16 is integrally configured of an arm part 29 extending in the front-to-rear direction, and a cam part 34 provided on the rear end of the arm part 29.

The front end of the arm part 29 is coupled with the front cover 7 (FIG. 1) by a linking mechanism (not shown) and slides in the front-to-rear direction in association with the opening and closing of the front cover 7.

An elongated hole 43 extending in the front-to-rear direction is formed in the cam part 34. The cam part 34 has a retracting part 39, an advancing part 40, and a sloped part 110. The retracting part 39 is provided around the rear end of the elongated hole 43 that is formed thicker in the width direction than the remainder of the cam part 34. The advancing part 40 is provided around the front end of the elongated hole 43 that is formed thinner in the width direction than the retracting part 39. The sloped part 110 connects the retracting part 39 to the advancing part 40 around the periphery of the elongated hole 43 and grows gradually thicker in the outer width direction (leftward) from the advancing part 40 to the retracting part 39.

The cylindrical collar member 83 of the collar 42 penetrates through the elongated hole 43 in the width direction so that the flange part 84 of the collar 42 contacts one of the retracting part 39, the advancing part 40, and sloped part 110 from the outside in the width direction. Due to the urging force of the coil spring 35, the cylindrical collar member 83 is constantly urged in the advancing direction of the collar 42 (rightward or inward in the width direction) along the driving gear 73, thereby contacting the flange part 84 to one of the retracting part 39, the advancing part 40, and the sloped part 110.

When the front cover 7 is opened, as shown in FIG. 8(*a*), the arm part 29 of the translation arm 16 slides rearward in association with the opening of the front cover 7 until the flange part 84 of the collar 42 comes into contact with the advancing part 40. At this time, the urging force of the coil spring 35 advances the collar 42 over the driving gear 73 to the advanced position in which the collar 42 is inserted through the through-hole 50 of the first wall part 49, as shown in FIG. 6(*b*). When the collar 42 is in the advanced position, the right end of the cylindrical collar member 83 covers the free end of the driving gear 73 and is positioned between the first wall part 49 and the cover plate 101 when the developer cartridge 28 is mounted in the main casing 2, as will be described later.

When the front cover 7 is closed, as shown in FIG. 8(*b*), the arm part 29 of the translation arm 16 slides forward in association with the closing operation of the front cover 7, and the flange part 84 of the collar 42 slides from the advancing part 40 to the sloped part 110 and subsequently to the retracting part 39 and remains in contact with the retracting part 39. At this time, the collar 42 is retracted relative to the driving gear 73 against the urging force of the coil spring 35 and is placed in a retracted position separated from the through-hole 50 of the first wall part 49, as shown in FIG. 6(*a*). When the collar 42 is in this retracted position, the right end of the cylindrical collar member 83 is positioned outside (leftward) of the first wall part 49 in the width direction so that the free end of the driving gear 73 is exposed from the cylindrical collar member 83.

(c) Mounting and Removing the Developer Cartridge (c-1) Mounting the Developer Cartridge in the Main Casing When the front cover 7 is opened, as shown in FIGS. 6(*b*) and 8(*a*), the translation arm 16 slides rearward in association with the opening operation of the front cover 7 through the linking mechanism (not shown). As a result, the flange part 84 of the collar 42 that was in contact with the retracting part 39 comes into contact with the advancing part 40, thereby moving the collar 42 is moved to the advanced position.

While being mounted in the drum accommodating section 103 of the drum cartridge 27, the developer cartridge 28 is mounted in the accommodating section 6 of the main casing 2 by being inserted in a rearward direction from the front side of the main casing 2. When the developer cartridge 28 is being mounted in the drum cartridge 27, a part of the gear cover 77 surrounding the gear mechanism 45 is exposed from the drum cartridge 27. As the developer cartridge 28 is inserted in the rearward direction, the input gear 68 on the developer cartridge 28 advances and retracts in the width direction as shown in FIG. 6(*c*). More specifically, at the beginning of the mounting operation, the input gear 68 is positioned opposite the second wall part 47 in the width direction. Since a gap is formed between the left endface of the coupling gear 82 on the input gear 68 and the right side surface of the second wall part 47 in the width direction, the input gear 68 is in the advanced position and does not retract in the width direction while opposing the second wall part 47.

As the developer cartridge 28 moves farther rearward, the input gear 68 moves opposite the third wall part 48, as illustrated in FIGS. 6(*c*) and 6(*b*). Since the third wall part 48 slopes inward in the width direction (rightward) from the rear end of the second wall part 47 to the front end of the first wall part 49, the left endface of the coupling gear 82 contacts and slides along the right surface of the third wall part 48 as the developer cartridge 28 moves rearward, and the input gear 68 moves gradually rightward against the urging force of the coil spring 37. When the input gear 68 moves to a position at which the third wall part 48 joins the first wall part 49, the input gear 68 has moved rightward the maximum distance and is in the retracted position.

As the developer cartridge 28 is moved farther rearward, the input gear 68 is in opposition to the first wall part 49 and is therefore maintained in the retracted position.

When the developer cartridge 28 is subsequently completely mounted in the accommodating section 6, the coupling gear 82 of the input gear 68 gets on the cylindrical collar member 83 through the coupling insertion hole 8 after the gear-side sloped surface 51 has contacted the collar-side sloped surface 115 (see FIG. 7). Hence, the left endface of the coupling gear 82 opposes and contacts the right endface of the cylindrical collar member 83 between the first wall part 49 and the cover plate 101. At this time, the coupling gear 82 coaxially confronts the cylindrical collar member 83 and similarly coaxially confronts the driving gear 73 fitted inside the collar 42.

Next, when the front cover 7 is closed, as shown in FIGS. 6(*a*) and 8(*b*), the translation arm 16 slides forward in association with the closing operation of the front cover 7 through the linking mechanism (not shown). As a result, the flange part 84 of the collar 42 comes into contact with the retracting part 39, thereby moving the collar 42 to the retracted position.

As the collar 42 moves leftward from the advanced position to the retracted position, the free end of the driving gear 73 becomes exposed from the right end of the cylindrical collar member 83 and, simultaneously, the coupling gear 82 of the input gear 68 moves leftward through the urging force of the coil spring 37 to the advanced position while remaining in contact with the collar 42. As the coupling gear 82 moves further leftward, the free end of the driving gear 73 comes into contact with the key 74 with pressure. This pressure adjusts the phase of the coupling gear 82 of the input gear 68 with respect to the driving gear 73 so that the driving gear 73 is inserted in the key 74. As a result, the driving gear 73 is engaged with the keys 74, thereby coupling the driving gear 73 with the input gear 68. Therefore, a driving force from a motor (not shown) can be transferred to the gear mechanism 45 via the driving gear 73 and the input gear 68. Note that the construction of adjusting the phase of the input gear 68 (the key 74) with respect to the driving gear 73 is well-known in the art, detailed description thereof will be omitted.

During image formation, a driving force from the motor (not shown) is transmitted to the gear mechanism 45 via the driving gear 73 and the input gear 68. As shown in FIG. 5(*a*), the driving force is transmitted from the input gear 68 in the gear mechanism 45 to the agitator drive gear 69 via the intermediate gear 70 for rotating the agitator 46. The driving force is also transmitted from the input gear 68 to the developing roller drive gear 71 for rotating the developing roller 32, and from the input gear 68 to the supply roller drive gear 72 for rotating the supply roller 31.

(c-2) Removing the Developer Cartridge from the Main Casing

When the front cover 7 is opened, as shown in FIGS. 6(*b*) and 8(*a*), the translation arm 16 slides rearward in association with the opening operation of the front cover 7 through the linking mechanism (not shown). As a result, the flange part 84 of the collar 42 is placed in contact with the advancing part 40, thereby moving the collar 42 to the advanced position.

As the collar 42 moves rightward from the retracted position to the advanced position, the free end of the driving gear 73 is once again covered by the right end of the cylindrical collar member 83. Simultaneously, the coupling gear 82 is pushed rightward from the advanced position to the retracted position against the urging force of the coil spring 37 while remaining in contact with the cylindrical collar member 83. At this time, the coupling gear 82 is retracted from the free end of the driving gear 73, disengaging the keys 74 from the free end of the driving gear 73 and, hence, uncoupling the driving gear 73 from the input gear 68.

The developer cartridge 28 is subsequently pulled forward from the accommodating section 6. As the developer cartridge 28 is pulled forward, the input gear 68 sequentially opposes the first wall part 49, the third wall part 48, and the second wall part 47 in reverse order to the order when the developer cartridge 28 was mounted in the accommodating section 6. As the developer cartridge 28 moves over the third wall part 48, the input gear 68 moves leftward from the retracted position and is in the advanced position by the junction between the third wall part 48 and the second wall part 47. Subsequently, the developer cartridge 28 is separated from the main casing 2.

3. Operations and Effects of the Aspect

As described above with FIGS. 6(*a*)-6(*c*), the developer cartridge 28 is provided with the input gear 68. Since the input gear 68 slides in the left and right directions to advance and retract, the input gear 68 is more susceptible to damage than the driving gear 73 provided on the main casing 2. If such damage were to occur, the user needs only repair the developer cartridge 28, which is much less costly than the main casing 2. In some cases, the problem may be solved simply by replacing the developer cartridge 28 itself. As a result, this construction facilitates maintenance.

Further, the input gear 68 advances and retracts between the advanced position (see FIG. 6(*a*)) and the retracted position (see FIG. 6(*b*)). In the advanced position, the input gear 68 moves leftward until the left endface of the outer gear 81 contacts the peripheral edge of the coupling insertion hole 8 at the cover plate 101 and the coupling gear 82 engages with the driving gear 73. In the retracted position, the input gear 68 moves rightward and only the left endface and the gear-side sloped surface 51 of the coupling gear 82 are exposed on the left side of the gear cover 77 via the coupling insertion hole 8.

Since the input gear 68 can move between the advanced position and the retracted position, it is possible to reliably couple and reliably uncouple the input gear 68 and the driving gear 73.

The developer cartridge 28 is also provided with the coil spring 37 for urging the input gear 68 leftward, and the gear cover 77 for restricting leftward movement of the input gear 68.

Accordingly, it is possible to restrict leftward movement of the input gear 68 through a simple construction, making it possible to regulate the leftward movement of the input gear 68 to a distance required for coupling with the driving gear 73. Further, the coil spring 37 constantly urges the input gear 68 leftward so that the input gear 68 reliably engages with the driving gear 73 through a simple construction.

The input gear 68 is fitted over the input gear support shaft 79 so as to be capable of sliding in the left-to-right direction by inserting the input gear support shaft 79 into the shaft insertion recess 78 of the input gear 68. Also, the right end of the coil spring 37 contacts the left side wall 38, and the left end contacts the right endface of the inner gear 80.

Therefore, when the input gear 68 is advanced toward the driving gear 73, the input gear support shaft 79 accurately guides the input gear 68 toward the driving gear 73. Accordingly, the input gear 68 can be reliably and stably coupled with the driving gear 73 through a simple construction.

Further, since the input gear support shaft 79 functions both to support the input gear 68 and to guide the input gear 68 toward the driving gear 73, the number of required parts can be reduced.

Further, by providing the coil spring 37 over the input gear support shaft 79, the coil spring 37 urges the input gear 68 to advance reliably toward the driving gear 73, thereby ensuring a reliable and stable engagement between the input gear 68 and the driving gear 73.

Further, since the gear cover 77 of the developer cartridge 28 functions both to protect the gear mechanism 45 and to restrict movement of the input gear 68, there is no need to provide a special member for restricting movement of the input gear 68, thereby reducing the number of required parts.

While the input gear 68 advances and retracts via the coupling insertion hole 8, portions of the gear cover 77 other than the coupling insertion hole 8 protect the gear mechanism 45, thereby enabling the gear cover 77 to protect the gear mechanism 45 while allowing advancing and retracting of the input gear 68.

The input gear 68 is coupled with the driving gear 73 through the coupling gear 82 so as to be incapable of rotating relative to the driving gear 73, while the inner gear 80 of the input gear 68 is engaged with the developing roller drive gear 71. Accordingly, the input gear 68 can reliably and effectively transmit a driving force from the driving gear 73 to the developing roller drive gear 71.

With the input gear 68 having this construction, the engaged state between the inner gear 80 and the developing roller drive gear 71 and supply roller drive gear 72 and the engaged state between the outer gear 81 and the intermediate gear 70 are constantly maintained over the entire range that the input gear 68 advances and retracts in the left-to-right direction.

Thus, when the input gear 68 is coupled with the driving gear 73, the input gear 68 can reliably transmit the driving force from the driving gear 73 to the developing roller drive gear 71, the supply roller drive gear 72, and the intermediate gear 70.

While the area of engagement between the inner teeth 75 of the input gear 68 and the developing roller drive gear 71 and supply roller drive gear 72 does not change when the input gear 68 moves between the advanced position and the retracted position, the area of engagement between the outer teeth 90 and the intermediate gear 70 increases when the input gear 68 moves from the retracted position to the advanced position.

Accordingly, the total area of engagement between the input gear 68 and the developing roller drive gear 71, supply roller drive gear 72, and intermediate gear 70 is greater when the input gear 68 is in the advanced position and coupled with the driving gear 73 than when the input gear 68 is in the retracted position and disengaged from the driving gear 73. Hence, the input gear 68 can reliably transmit the driving force of the driving gear 73 to the developing roller drive gear 71, the supply roller drive gear 72, and the intermediate gear 70.

As shown in FIG. 7, the gear-side sloped surface 51 is formed on the free end of the coupling gear 82. Hence, when the developer cartridge 28 is mounted in the main casing 2, the gear-side sloped surface 51 can guide the coupling gear 82 in the advancing and retracting directions, even when the left end of the coupling gear 82 contacts the guide wall 41. The gear-side sloped surface 51 can reduce the amount of friction produced by the left end of the coupling gear 82 contacting the guide wall 41 so that the input gear 68 smoothly engages with or disengages from the driving gear 73.

As described above, the collar-side sloped surface 115 is formed on the cylindrical collar member 83. When the developer cartridge 28 is mounted in the accommodating section 6, the coupling gear 82 of the input gear 68 can smoothly get on and come into contact with the cylindrical collar member 83 via the gear-side sloped surface 51 and the collar-side sloped surface 115.

As described above, as the developer cartridge 28 is mounted in the main casing 2, the input gear 68 first passes over the second wall part 47, contacts the third wall part 48, and is retracted rightward by a distance corresponding to the gap between the first wall part 49 and the second wall part 47 in the width direction. When the front cover 7 is closed with the developer cartridge 28 mounted in the main casing 2, the input gear 68 advances toward and engages with the driving gear 73 at the first wall part 49.

In this way, the input gear 68 can be moved in the advancing and retracting directions through a simple construction. Further, the input gear 68 can be engaged with the driving gear 73 at the same the front cover 7 is closed with the developer cartridge 28 mounted in the main casing 2.

Further, the input gear 68 and the driving gear 73 can be engaged or disengaged through a simple construction of the collar 42, enabling the developer cartridge 28 to be smoothly mounted in the main casing 2.

Since the cylindrical collar member 83 of the collar 42 is fitted over the driving gear 73, the input gear 68 can be reliably engaged with and separated from the driving gear 73 when coupling the input gear 68 with the driving gear 73 or uncoupling the input gear 68 from the driving gear 73, thereby achieving reliable coupling and uncoupling between the input gear 68 and driving gear 73.

When the right endface of the cylindrical collar member 83 is positioned opposite the coupling gear 82, the coil spring 35 urges the cylindrical collar member 83 to contact the left endface of the coupling gear 82. Accordingly, the collar 42 ensures reliable coupling and uncoupling between the input gear 68 and the driving gear 73, thereby achieving smooth mounting and removal of the developer cartridge 28 with respect to the main casing 2.

When the collar 42 is in the advanced position and the input gear 68 is in the retracted position, the right end of the cylindrical collar member 83 contacts the left end of the coupling gear 82 at a widthwise position between the first wall part 49 and the cover plate 101. This construction reduces the possibility of the right end of the cylindrical collar member 83 or the left end of the coupling gear 82 catching on the corresponding cover plate 101 or first wall part 49 when removing the developer cartridge 28 from the main casing 2, thereby ensuring smooth removal of the developer cartridge 28 from the main casing 2.

As shown in FIG. 7, the hole-side sloped surface 52 is formed in the through-hole 50 of the first wall part 49 as a chambered surface that gradually increases in diameter from the left side surface to the right side surface of the guide wall 41. Therefore, even if the left end of the coupling gear 82 contacts the peripheral edge of the through-hole 50 formed in the guide wall 41 when mounting the developer cartridge 28 into or removing the developer cartridge 28 from the main casing 2, the hole-side sloped surface 52 can guide the coupling gear 82 in the advancing and retracting directions and can reduce the amount of friction generated through contact between the left end of the coupling gear 82 and the peripheral edge of the through-hole 50. Hence, this construction ensures the smooth movement of the input gear 68 in the advancing and retracting directions and ensures smooth mounting of the developer cartridge 28 into and removal of the developer cartridge 28 from the main casing 2

As described above, the key-side sloped surface 113 and drive-gear-side sloped surface 114 can smoothly guide the input gear 68 from the retracted position to the advanced position to ensure that the input gear 68 reliably couples with the driving gear 73.

4. Variations

While the invention has been described in detail with reference to the above aspect thereof, it would be apparent to those skilled in the art that various changes and modifications may be made therein without departing from the spirit of the invention.

(a) Variation of the Structure for Coupling the Input Gear with the Drive Gear

As a variation of the aspect described above, it is possible to eliminate the collar 42. This variation will be described next with reference to FIG. 9, wherein like parts and components are designated with the same reference numerals to avoid duplicating description.

In this variation, a tapered surface 112 is formed on the outer surface of the coupling gear 82. The tapered surface 112 tapers from right to left between the right end of the coupling gear 82 and the gear-side sloped surface 51. To match this shape of the input gear 68, a cover-side sloped surface 111 is formed on the edge of the coupling insertion hole 8 as a chambered surface that gradually grows larger in diameter from the left side surface to the right side surface of the cover plate 101, similar to the hole-side sloped surface 52.

Figure 9A:
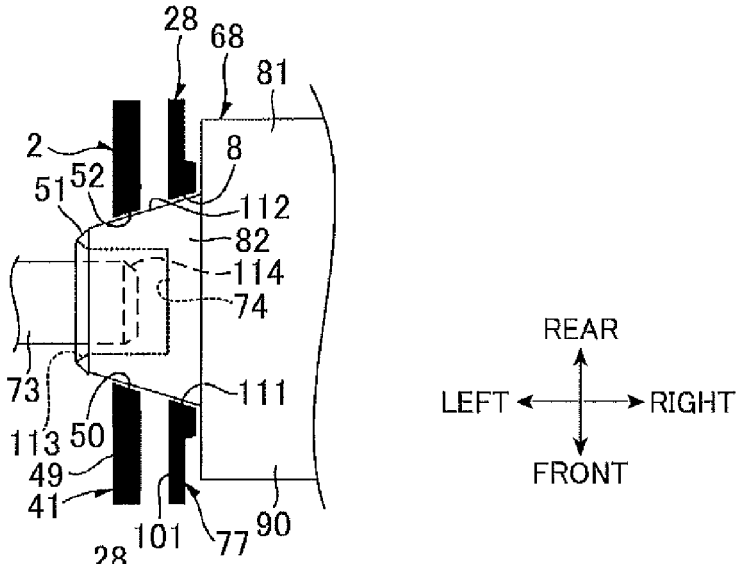
FIG. 9(*a*) is a schematic diagram showing a driving gear and an input gear in a coupled state according to a variation of aspects.
Figure 9B:
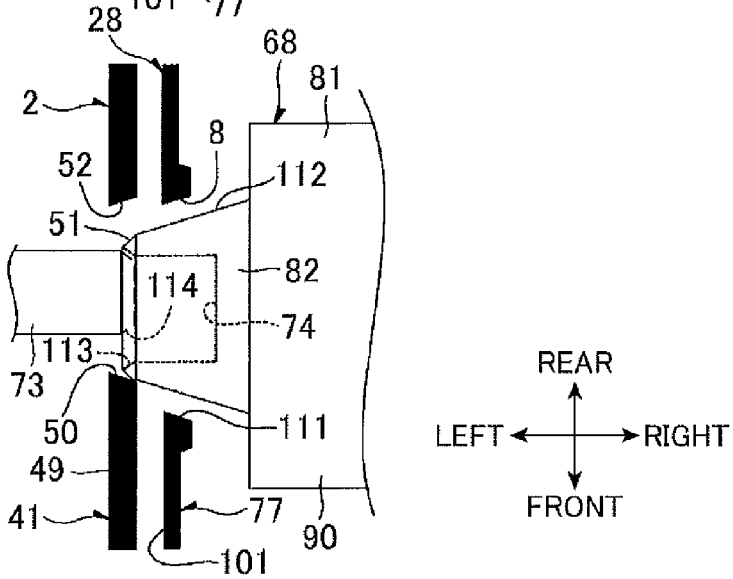
Figure 9C:
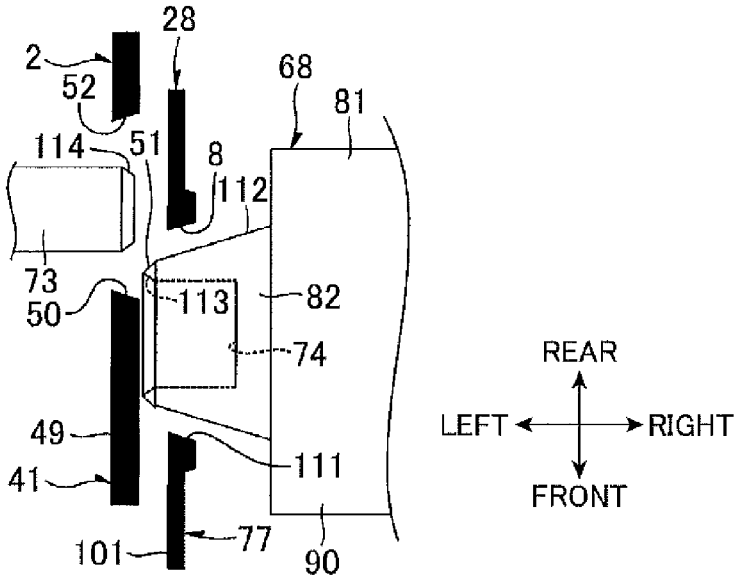

With the coupling gear 82 having this shape, the input gear 68 engaged with the driving gear 73 in the advanced position (see FIG. 9(*a*)) contacts the tapered surface 112 and the hole-side sloped surface 52 as the developer cartridge 28 is pulled forward from the accommodating section 6. The tapered surface 112 and the hole-side sloped surface 52 convert the force applied to pull the developer cartridge 28 forward to a force acting in the right direction so that the input gear 68 moves rightward against the urging force of the coil spring 37 as the developer cartridge 28 is pulled forward (see FIG. 9(*b*)).

As the developer cartridge 28 is pulled farther forward, the coupling gear 82 slips off of the driving gear 73 via the key-side sloped surface 113 and the drive-gear-side sloped surface 114 and subsequently contacts the right side surface of the first wall part 49 due to the urging force of the coil spring 37 (see FIG. 9(*c*)). In this way, the input gear 68 is disengaged from the driving gear 73 and slides along the right surface of the guide wall 41 as the developer cartridge 28 is removed from the main casing 2.

The opposite process occurs when mounting the developer cartridge 28 in the main casing 2. Specifically, as the developer cartridge 28 is inserted into the main casing 2 in the rearward direction (see FIG. 9(*c*)), the coupling gear 82 is moved to a position opposite the through-hole 50. When the tapered surface 112 contacts the hole-side sloped surface 52 and the key-side sloped surface 113 contacts the drive-gear-side sloped surface 114 (see FIG. 9(*b*)), the input gear 68 is guided along these sloped surfaces 113, 114 to a position coaxially opposing the driving gear 73 and smoothly engages with the driving gear 73 (see FIG. 9(*a*)).

Hence, this construction enables the engagement and disengagement of the input gear 68 and the driving gear 73 through a simple structure that omits both the collar 42, the translation arm 16 and the coil spring 35, thereby reducing the number of required parts.

(b) Variation of the position of the driving gear

In the aspects described above, the driving gear 73 is disposed on the main casing 2 and the driving gear 73 is engaged with the input gear 68 when the developer cartridge 28 mounted on the drum cartridge 27 is mounted on the laser printer 1. However, the driving gear 73 may be disposed on the drum cartridge 27. In this case, the driving gear 73 can even be engaged with the input gear 68 outside the main casing 2 when the developer cartridge 28 is mounted on the drum cartridge 28.

(c) Variation of the Laser Printer

In the aspect described above, the invention is applied to a monochromatic laser printer. However, the invention may by applied to a tandem type color laser printer that directly transfers toner images onto paper from photosensitive drums for a plurality of colors, or to an intermediate transfer type color laser printer that first temporarily transfers toner images in each color from photosensitive members onto an intermediate transfer member and subsequently transfers the entire color image onto the paper at once.

What is claimed is:

1. A developer cartridge comprising:

a cartridge housing;

a developing roller disposed within the cartridge housing, the developing roller having a developing roller shaft a transmitting rotator being fixedly supported by an end portion of the developing roller shaft; and a first rotator configured to transmit a driving force to the transmitting rotator, wherein the first rotator is movable with respect to the cartridge housing in an advancing direction parallel to an axial direction of the developing roller and in a retracting direction opposite the advancing direction.

2. The developer cartridge as claimed in claim 1, further comprising a restricting member that restricts the movement of the first rotator in the advancing direction and an urging member that urges the first rotator in the advancing direction.

3. The developer cartridge as claimed in claim 2, wherein: the developer cartridge is detachably mountable in an image-forming device having a second rotator;

the first rotator is configured to couple with the second rotator when the developer cartridge is mounted in the image-forming device so as to receive the driving force from the second rotator to rotate the developing roller;

the restricting member is formed with an opening through which the first rotator moves in the advancing and retracting directions; the first rotator is movable between an advanced position and a retracted position on an upstream side of the advanced position in the advancing direction; the first rotator at the advanced position couples with the second rotator when the developer cartridge is mounted in the image-forming device; and only a downstream edge of the first rotator in the advancing direction is exposed from the restricting member through the opening when the first rotator is at the retracted position.

4. The developer cartridge as claimed in claim 3, further comprising an engaging member that engages with the first rotator, the engaging member including the transmitting rotator;

wherein an area of engagement between the first rotator and the engaging member is greater when the first rotator is in the advanced position than when the first rotator is in the retracted position.

5. The developer cartridge as claimed in claim 2, further comprising the transmitting rotator that engages with the first rotator, wherein the restricting member is a cover member that protects the transmitting rotator.

6. The developer cartridge as claimed in claim 5, wherein the restricting member is formed with an opening through which the first rotator moves in the advancing and retracting directions.

7. The developer cartridge as claimed in claim 5, wherein the first rotator is movable in the advancing and retracting directions within a predetermined range, and the first rotator is constantly engaged with the transmitting rotator.

8. The developer cartridge as claimed in claim 1, further comprising a guide part that guides the movement of the first rotator in the advancing and retracting directions.

9. The developer cartridge as claimed in claim 8, wherein the guide part is a shaft that supports the first rotator.

10. The developer cartridge as claimed in claim 9, further comprising a restricting member that restricts the movement of the first rotator in the advancing direction and a coil spring that urges the first rotator in the advancing direction and is fitted over the shaft.

11. The developer cartridge as claimed in claim 1, wherein: the developer cartridge is detachably mountable in an image-forming device including a second rotator;

the first rotator is configured to couple with the second rotator when the developer cartridge is mounted in the image-forming device so as to receive the driving force from the second rotator to rotate the developing roller.

12. The developer cartridge as claimed in claim 11, wherein the a transmitting rotator engages with the first rotator to transmit the driving force from the first rotator to the developing roller, wherein the first rotator includes a coupling part that is configured to couple with the second rotator and an engaging part that engages with the transmitting rotator.

13. The developer cartridge as claimed in claim 12, wherein the coupling part of the first rotator has a sloped surface formed by chamfering a side endface of the coupling part at an axial end of the coupling part, the sloped surface guiding the movement of the first rotator in the advancing and retracting directions.

14. An image-forming device comprising:

a main casing including a side wall;

a first rotator disposed on the main casing; and a developer cartridge detachably mountable in the main casing, the developer cartridge including a developing roller and a second rotator that is movable in an advancing direction parallel to an axial direction of the developing roller toward the first rotator and in a retracting direction opposite the advancing direction, wherein the second rotator receives a driving force from the first rotator when coupled with the first rotator, thereby rotating the developing roller;

wherein: the side wall opposes the second rotator when mounting and detaching the developer cartridge to and from the main casing; and the side wall includes:

a first wall part that runs parallel to a mounting direction of the developer cartridge that is orthogonal to the advancing and retracting directions, wherein the first rotator is disposed on the first wall part;

a second wall part that runs parallel to the mounting direction and is disposed upstream of the first wall part in the mounting direction and downstream in the advancing direction; and a third wall part disposed between the first and second wall parts in the mounting direction and sloped toward the upstream side in the advancing direction from the upstream side to the downstream side in the mounting direction.

15. The image-forming device as claimed in claim 14, further comprising an advancing/retracting member configured to move relative to the second rotator between a first position and a second position on the upstream side of the first position in the advancing direction, wherein the advancing/retracting member is in the first position when the second rotator is coupled with the first rotator, and the advancing/retracting member is in the second position when the second rotator is uncoupled from the first rotator.

16. The image-forming device as claimed in claim 15, wherein the advancing/retracting member is brought into contact with a downstream end of the second rotator in the advancing direction when the second rotator is brought into opposition to the first rotator.

17. The image-forming device as claimed in claim 16, wherein the developer cartridge includes a restricting member that restricts the movement of the second rotator in the advancing direction, and the advancing/retracting member in the second position contacts the second rotator at a position between the first wall part and the restricting member in the advancing direction.

18. The image-forming device as claimed in claim 15, wherein the advancing/retracting member is cylindrical in shape and is fitted over the first rotator.

19. The image-forming device as claimed in claim 14, wherein the first wall part is formed with an opening into which the second rotator is inserted, and the opening is defined by a sloped surface that slops inward toward the advancing direction, the sloped surface guiding the movement of the second rotator in the advancing and retracting directions.

20. A developer cartridge that is detachably mountable in an image-forming device having a second rotator, the developer cartridge comprising:

a developing roller; and a first rotator configured to couple with the second rotator when the developer cartridge is mounted in the image-forming device, the first rotator being movable in an advancing direction parallel to an axial direction of the developing roller toward the second rotator and in a retracting direction opposite the advancing direction, wherein the first rotator receives a driving force from the second rotator when coupled with the second rotator, thereby rotating the developing roller.

* * * * *